US011309176B2

(12) United States Patent
Nikawa

(10) Patent No.: US 11,309,176 B2
(45) Date of Patent: Apr. 19, 2022

(54) SHORT-ARC DISCHARGE LAMP

(71) Applicant: Ushio Denki Kabushiki Kaisha, Tokyo (JP)

(72) Inventor: Shinji Nikawa, Tokyo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/953,615

(22) Filed: Nov. 20, 2020

(65) Prior Publication Data

US 2021/0159065 A1 May 27, 2021

(30) Foreign Application Priority Data

Nov. 26, 2019 (JP) ..... JP2019-212841

(51) Int. Cl.
*H01J 61/36* (2006.01)
*H01J 61/33* (2006.01)
*H01J 61/16* (2006.01)

(52) U.S. Cl.
CPC ..... *H01J 61/33* (2013.01); *H01J 61/36* (2013.01); *H01J 61/368* (2013.01); *H01J 61/16* (2013.01)

(58) Field of Classification Search
CPC ..... H01J 61/36; H01J 61/368
USPC ..... 313/357
See application file for complete search history.

(56) References Cited

U.S. PATENT DOCUMENTS 4,550,269 A * 10/1985 Dixon ..... H01J 61/366 174/50.61
6,600,266 B1 * 7/2003 Nakagawa ..... H01J 5/38 313/326
7,153,179 B2 * 12/2006 Emilsson ..... C23C 30/00 445/58
2010/0188855 A1 * 7/2010 Sakaguchi ..... H01J 61/368 362/296.09
2011/0074285 A1 * 3/2011 Buttstaedt ..... H01J 61/547 313/623
2012/0049731 A1 3/2012 Baacke et al.

FOREIGN PATENT DOCUMENTS

JP 2006264413 A * 10/2006

* cited by examiner

*Primary Examiner* — Christopher M Raabe
(74) *Attorney, Agent, or Firm* — Studebaker & Brackett PC

(57) ABSTRACT

A short-arc discharge lamp may include an arc tube section; at least one side tube section connected to at least one end of the arc tube section; at least one electrode provided inside the arc tube section; and at least one lead rod which is provided inside the at least one side tube section and which is connected to the at least one electrode; wherein the at least one lead rod has at least one metal body disposed so as to be in contact with the at least one lead rod; the at least one side tube section has at least one reduced diameter region; the at least one lead rod is supported by the at least one reduced diameter region via the at least one metal body; and at least one coating film is formed on at least one surface of the at least one metal body.

11 Claims, 2 Drawing Sheets

SHORT-ARC DISCHARGE LAMP

BACKGROUND OF THE INVENTION

Field of the Invention

The present invention relates to a short-arc discharge lamp.

Description of the Related Art

Conventionally, a short-arc discharge lamp has been known as a light source used for, for example, a projector and a solar simulator. The short-arc discharge lamp is configured such that an anode and a cathode are disposed within an arc tube section made of glass with their tips facing each other, and a light emitting gas such as xenon gas is sealed. A direct current voltage is applied between the anode and the cathode to generate the arc discharge between the tip of the anode and the tip of the cathode, and desired light is extracted. Lead rods are connected to the rear end of the anode and the rear end of the cathode, respectively. The lead rods are supported by a pair of side tube sections connected to each end of the arc tube section.

In a discharge lamp disclosed in Patent Document 1, side tube sections support lead rods via wires wound around the lead rods.

PRIOR ART DOCUMENT

Patent Document

Patent Document 1: US 2012/0049731 A

SUMMARY OF THE INVENTION

In recent years, improvement of pressure resisting strength of discharge lamps has been demanded. It has been found by the inventor's earnest research that, in the discharge lamp disclosed in Patent Document 1, the wires wound around the lead rods and inner walls of the side tube sections are in close contact with each other to cause local strain, and a crack (microcrack) may occur due to the strain. The crack becomes a starting point of rupture of the lamp and reduces the pressure resisting strength of the discharge lamp.

An object of the present invention is to provide a short-arc discharge lamp having improved pressure resisting strength.

The short-arc discharge lamp includes an arc tube section; at least one side tube section connected to at least one end of the arc tube section; at least one electrode provided inside the arc tube section; and at least one lead rod which is provided inside the at least one side tube section and which is connected to the at least one electrode; in which the at least one lead rod has at least one metal body disposed so as to be in contact with the at least one lead rod; the at least one side tube section has at least one reduced diameter region; the at least one lead rod is supported by the at least one reduced diameter region via the at least one metal body; and at least one coating film is formed on at least one surface of the at least one metal body.

The at least one end of the arc tube section may include a first end and a second end. The at least one side tube section may include a first side tube section and a second side tube section. The at least one electrode may include an anode and a cathode. The at least one lead rod may include a first lead rod and a second lead rod. The at least one metal body may include a first metal body and a second metal body. The at least one coating film may include a first coating film and a second coating film. The at least one surface may include a first surface and a second surface. The first side tube section and the second side tube section may be respectively connected to the first end and the second end of the arc tube section. The first lead rod and the second lead rod may be respectively provided inside the first side tube section and the second side tube section, and may be respectively connected to the anode and the cathode. The first coating film and the second coating film may be respectively formed on the first surface and the second surface, the first surface and the second surface respectively being present at the first metal body and the second metal body, the first side tube supporting the first lead rod via the first metal body, and the second side tube supporting the second lead rod via the second metal body.

With the above configuration, the coating film contacts the surface of the metal body and the surface of the side tube section, and this coating film prevents close contact between the surface of the metal body and the inner wall of the side tube section. Thus, even if the side tube section and the metal body having different thermal expansion coefficients repeat thermal expansion due to the lamp being turned on or thermal contraction due to the lamp being turned off, accumulation of strain in the side tube section is suppressed, whereby a crack that can be the starting point of rupture of the lamp is less likely to occur in the side tube section. Accordingly, the pressure resisting strength of the lamp is improved.

DETAILED DESCRIPTION OF THE PREFERRED EMBODIMENTS

Figure 1:
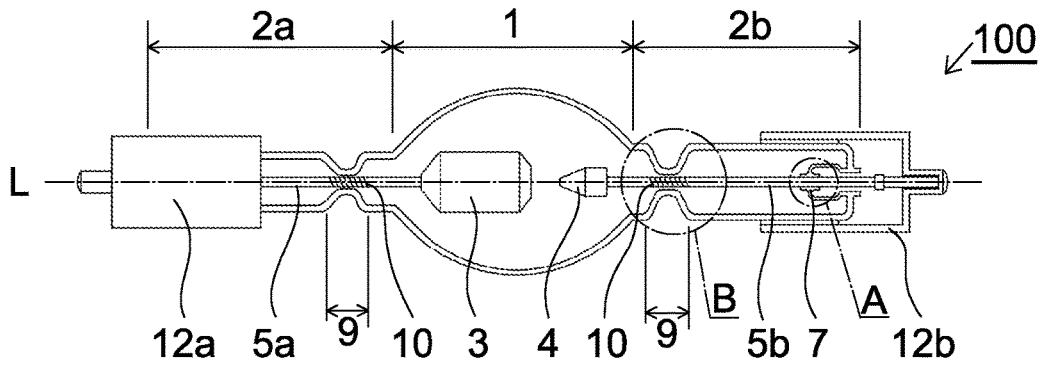
FIG. 1 is a diagram showing an embodiment of a short-arc discharge lamp.

A short-arc discharge lamp according to the present invention will be described with reference to the drawings. It is to be noted that the drawings in the present specification are merely schematic. That is, the dimensional ratio in the drawings does not always reflect the actual dimensional ratio, and may not necessarily be the same among the drawings.

FIG. 1 shows an embodiment of a short-arc discharge lamp. A short-arc discharge lamp 100 (hereinafter referred to as "lamp 100") according to the present embodiment includes an arc tube section 1 and a pair of side tube sections (2*a*, 2*b*) connected to each end of the arc tube section 1. In other words, the lamp 100 is configured such that the arc tube section 1 is sandwiched between the pair of side tube sections (2*a*, 2*b*). The arc tube section 1 is formed by expanding a central region of a tube made of glass. Here, in the glass material in which the central region is expanded, a central region constituting the arc tube section 1 and an end region excluding the expanded portion are formed. Separate tube made of glass materials are connected to each end of the glass material in which the central region is expanded, whereby the side tube sections (2*a*, 2*b*) are formed. That is, the side tube sections (2*a*, 2*b*) are composed of end regions in the tube which the central region is expanded, and the separate tubes made of glass and connected to each the end of regions. It is preferable to use the same kind of glass material (for example, quartz glass) as the glass material in which the central region is to be expanded and the separate glass materials connected to each end. The outer shape of the arc tube section 1 may be a sphere or an ellipsoid. The outer shapes of the side tube sections (2*a*, 2*b*) may be tubes (excluding reduced diameter regions which will be described later). The outer diameter of each side tube section (2*a*, 2*b*) excluding the reduced diameter region is, for example, 30 mm. The outer diameter of the side tube section 2*a* and the outer diameter of the side tube section 2*b* may be the same or different from each other. The maximum outer diameter of the arc tube section 1 is larger than the maximum outer diameter of each side tube section (2*a*, 2*b*), and is, for example, 60 mm.

The central axes of the two side tube sections (2*a*, 2*b*) overlap with each other and are indicated by an axis L in FIG. 1. Further, the axis L may pass through the center point of the arc tube section 1. A predetermined amount of a light emitting substance such as xenon gas is sealed inside the lamp 100 (inside the arc tube section 1 and the side tube sections (2*a*, 2*b*)). Although not shown in FIG. 1, the arc tube section 1 usually has a small protrusion in many cases. The protrusion is a mark which is left after an exhaust pipe (also referred to as a "tip pipe") for exhausting a gas inside the arc tube section 1 and the side tube sections (2*a*, 2*b*) and sealing a light emitting substance such as xenon gas in the arc tube section 1 and the side tube sections (2*a*, 2*b*) is removed.

An anode 3 and a cathode 4 are provided inside the arc tube section 1. In the present specification, the short-arc discharge lamp is a lamp in which the anode 3 and the cathode 4 are arranged so as to face each other with a gap of 10 mm or less (a value when the lamp is turned off without thermal expansion). Lead rods (5*a*, 5*b*) are provided from the inside of the side tube sections (2*a*, 2*b*) to the inside of the arc tube section 1. The anode 3 is connected to the tip of the lead rod 5*a* on the cathode 4 side. The lead rod 5*a* supports the anode 3 so that the anode 3 is arranged inside the arc tube section 1. The cathode 4 is connected to the tip of the lead rod 5*b* on the anode 3 side. The lead rod 5*b* supports the cathode 4 so that the cathode 4 is arranged inside the arc tube section 1. The lead rod 5*a* is provided inside the side tube section 2*a*, and the lead rod 5*b* is provided inside the side tube section 2*b*. The central axes of the lead rods (5*a*, 5*b*) may overlap the axis L. A material containing a high-melting-point metal, such as tungsten, is used for the lead rods (5*a*, 5*b*).

The anode 3 has, for example, a columnar shape with a constant outer diameter in the central portion in a direction in which the axis L extends, a truncated cone shape in which the outer diameter decreases toward the tip on the tip side (side closer to the cathode 4), and a truncated cone shape in which the outer diameter decreases toward the rear end on the rear end side (side connected to the lead rod 5*a*). The maximum outer diameter of the anode 3 is, for example, 25 mm. The length of the anode 3 in the axis L direction is, for example, 35 mm. A material containing a high-melting-point metal such as tungsten is used for the anode 3. The central axis of the anode 3 may overlap the axis L.

The cathode 4 has, for example, a truncated cone shape in which the outer diameter decreases toward the tip on the tip side (side closer to the anode 3), and a columnar shape with a constant outer diameter on the rear end side (side connected to the lead rod 5*b*). The maximum outer diameter of the cathode 4 is, for example, 10 mm. The length of the cathode 4 in the axis L direction is, for example, 17 mm. A material containing a high-melting-point metal, for example, thoriated tungsten, is used for the cathode 4. The central axis of the cathode 4 may overlap the axis L.

The lead rods (5*a*, 5*b*) are electrically connected to bases (12*a*, 12*b*), respectively, and the lamp 100 is supplied with power from an external power source (not shown) via the bases (12*a*, 12*b*).

The structure of the lamp on the right side of the arc tube section 1 in FIG. 1 will be described below. The structure of the lamp on the left side of the arc tube section 1 may be the same as the structure described below.

The side tube section 2*b* supports the lead rod 5*b* at two locations, a first support section and a second support section closer to the cathode 4 than the first support section. The first support section corresponds to a part A in FIG. 1. In the part A, the side tube section 2*b* supports the lead rod 5*b* via a sealing glass 7 that alleviates the difference in thermal expansion between the side tube section 2*b* and the lead rod 5*b*. The second support section corresponds to a part B in FIG. 1. In the second support section, a reduced diameter region 9 of the side tube section 2*b* supports the lead rod 5*b*.

Regarding the second support section (part B in FIG. 1), the reduced diameter region 9 of the side tube section 2*b* indicates a region having a smaller diameter than the diameter of a region of the side tube section 2*b* excluding the reduced diameter region 9. The reduced diameter region 9 is formed by squeezing the side tube section 2*b*. The reduced diameter region 9 supports the lead rod 5*b*. The reduced diameter region 9 is formed by heating and squeezing the tubular side tube section 2*b* into which the lead rod 5*b* is inserted with a gas burner or the like.

Figure 2:
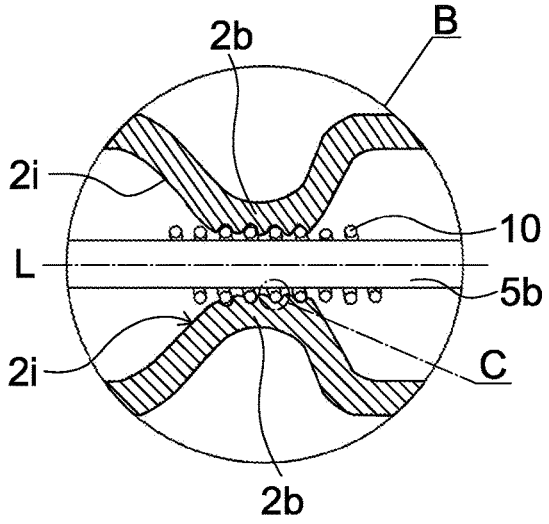
FIG. 2 is an enlarged view of a part B in FIG. 1.

A wire 10, which is a metal body, is spirally wound around the lead rod 5*b* so as to be in contact therewith in the reduced diameter region 9. FIG. 2 is an enlarged view of the part B in FIG. 1. In FIG. 2, the side tube section 2*b*, the lead rod 5*b*, and the wire 10 are shown in a cross section passing through the axis L. FIG. 2 shows not only the cross section passing through the axis L but also the state in which the wire 10 is wound around the lead rod (the same applies to FIG. 3 described later). In FIG. 2, the side tube section 2*b* is hatched with shaded area. Since the wire 10 is located between the lead rod 5*b* and an inner wall 2*i* of the side tube section 2*b* in the reduced diameter region 9, the wire 10 inhibits the inner wall 2*i* of the side tube section 2*b* from contacting the lead rod 5*b*. Thus, the side tube section 2*b* supports the lead rod 5*b* via the wire 10. A material containing tungsten or molybdenum is used for the wire 10, for example.

Note that the wire 10 is not limited to be spirally wound, and may have a structure in which a plurality of short wires wound once around the lead rod are continuously arranged in the extending direction (axis L direction) of the lead rod. The wire has features of being excellent in impact resistance, light weight, inexpensive, and easy to handle during manufacturing. However, the metal body which is interposed when the reduced diameter region supports the lead rod is not limited to the wire. For example, a tubular metal body or a foil-wrapped metal body can be used as the metal body which is interposed when the reduced diameter region supports the lead rod.

Figure 3:
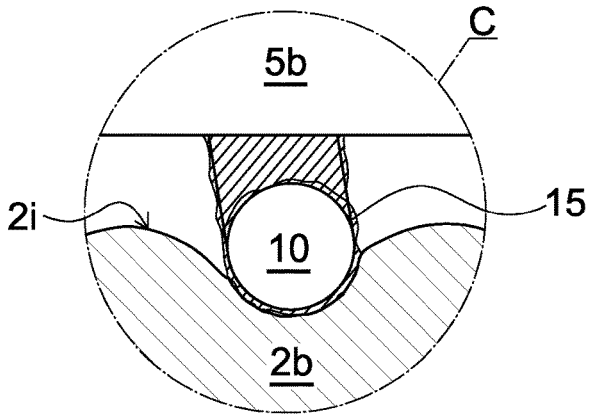
FIG. 3 is an enlarged view of a part C in FIG. 2.

FIG. 3 is an enlarged view of a part C in FIG. 2. The side tube section 2*b* is hatched with shaded area. As shown in FIG. 3, a coating film 15 is formed on the surface of the wire 10. In FIG. 3, the coating film 15 is hatched with shaded area. The coating film 15 contacts the surface of the side tube section 2*b*. Since the coating film 15 is located between the wire 10 and the side tube section 2*b*, the coating film 15 has an effect for preventing a direct contact between the surface of the wire 10 and the inner wall 2*i* of the side tube section 2*b*.

As described above, the side tube section 2*b* and the wire 10 have mutually different thermal expansion coefficients. If the side tube 2*b* and the wire 10 are in contact with each other, repeated temperature rise due to the lamp 100 being turned on and temperature drop due to the lamp 100 being turned off cause strain to accumulate in the side tube section 2*b* formed of glass material due to the difference in thermal expansion coefficient therebetween. When strain is accumulated in the side tube section 2*b*, a crack that may be a starting point of rupture of the lamp including the side tube section 2*b* is likely to occur. The wire 10, which is a metal material, is unlikely to crack even if strain is accumulated. In the present embodiment, as described above, the coating film 15 having an adhesion preventing effect is provided on the surface of the wire 10. Therefore, even if the temperature rise due to the lamp being turned on and the temperature drop due to the lamp being turned off are repeated, strain is unlikely to be accumulated in the side tube section 2*b*. As a result, an occurrence of crack, which may be the starting point of lamp rupture, can be suppressed. Then, suppressing the occurrence of cracks improves the pressure resisting strength of the lamp 100.

The film thickness of the coating film 15 is preferably 1 μm or more, and more preferably 10 μm or more. With this configuration, the effect of preventing close contact between the side tube section 2*b* and the wire 10 is enhanced. The film thickness of the coating film 15 is preferably 100 μm or less, and more preferably 50 μm or less. With this configuration, the coating film 15 is less likely to be detached from the wire 10 during manufacture. The thickness of the coating film 15 may not be uniform. Further, the wire 10 may have a portion in which the surface of the wire 10 is locally exposed without being covered by the coating film 15.

The thickness of the coating film 15 can be calculated as follows. The wire 10 on which the coating film 15 is formed is cut and mirror-polished, and then, the cut surface is observed by a scanning electron microscope. The thickness of the coating film 15 can be calculated on the basis of observed-image information.

The coating film 15 can be made of a metal oxide such as alumina ($Al_2O_3$), silica ($SiO_2$), or titania ($TiO_2$) that is stable at high temperature (e.g., about 1000° C.) Particularly, silica is suitably used, because it is the same as the glass component used for the arc tube section 1 and the side tube section 2*b*, and thus, even if the coating film 15 is mixed with the arc tube section 1 and the side tube section 2*b*, it exerts less influence on the characteristics of the lamp.

There are various possible methods for forming the coating film 15 on the wire 10. For example, a solution in which fine particles (having an average particle size of about 2.0 μm, for example) of silica or the like are dispersed may be applied on the wire 10, and the resultant may be dried for a predetermined time, and then sintered to form the coating film 15 on the wire 10. The solution may be applied using a tool for directly applying the solution, such as a brush, or may be sprayed by a spray or the like. Furthermore, after the coating film 15 is formed on the wire 10, the wire 10 having the coating film 15 may be wound around the lead rod 5*b*. Alternatively, the coating film 15 may be formed on the wire 10 wound around the lead rod 5*b*. The coating film 15 may be applied not only to the surface of the wire 10 but also to the surface of the lead rod 5*b*.

As described above, the structure of the lamp on the left side of the arc tube section 1 may be the same as the structure described above. That is, the wire 10 having the coating film 15 applied thereon may be used not only for the lead rod 5*b* but also for the lead rod 5*a*. However, the coating film 15 may be applied only on the wire 10 of the lead rod (5*a* or 5*b*) on one side.

EXAMPLE

[Preparation of Sample for Pressure Test]

Figure 4:
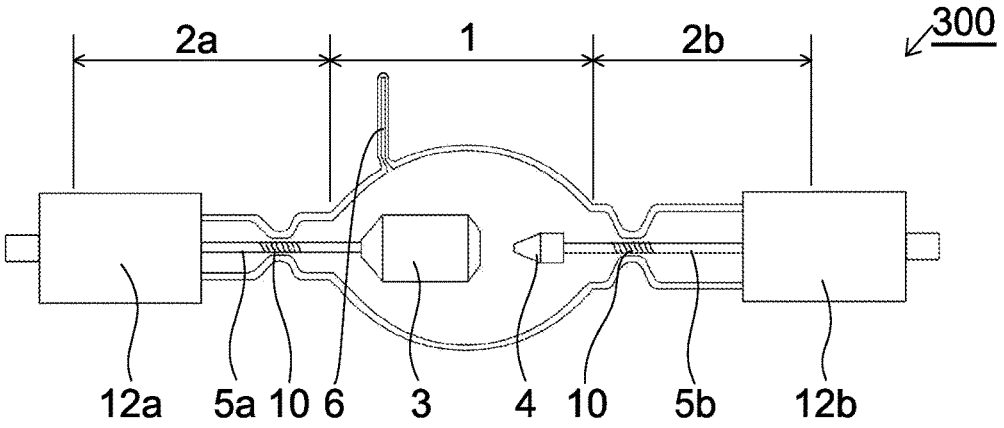
FIG. 4 is a diagram showing a short-arc discharge lamp for a pressure test.

Six short-arc discharge lamps 300 (hereinafter, referred to as "lamps 300") shown in FIG. 4 were prepared as pressure test samples. A xenon gas is sealed in each lamp 300 as a light emitting substance. The anode 3 and the cathode 4 of each lamp 300 are arranged so as to face each other with a space of 6 mm when the lamp is turned off (at room temperature) without thermal expansion. Each lamp 300 has a rated input power of 4 kW, a current of 121 A, and a voltage of 33 V. The arc tube section 1 and the side tube sections (2*a*, 2*b*) connected to the arc tube section 1 are made of quartz glass. The maximum outer diameter of the arc tube section 1 is 60 mm, and the length of the arc tube section 1 in the axis L direction is 82 mm.

In each lamp 300, the lead rods (5*a*, 5*b*) are made of tungsten having a cross section with an outer diameter of 6 mm, and the wire 10 is made of tungsten having a cross section with a wire diameter of 0.6 mm. Further, the wire 10 is spirally wound around the lead rods (5*a*, 5*b*) over a range of 30 mm. In each of three lamps 300 out of the six lamps 300, a coating film made of silica is formed on the surface of the wire 10 to prevent close contact between the inner wall 2*i* of the side tube section 2*b* and the wire 10. These three lamps are Samples 1 to 3. The coating film was formed on the wire 10 as follows. Specifically, the wire 10 was spirally wound around the lead rods (5*a*, 5*b*), and then, a solution prepared by dispersing silica particles in butyl acetate (solvent) was applied. The resultant was dried, and sintered by heating for a predetermined time. The remaining three lamps 300 out of the six lamps are Samples 4 to 6 in which the coating film is not formed on the surface of the wire 10. There is no particular difference between Samples 1 to 3 and Samples 4 to 6 in the configuration other than the presence or absence of the coating film. In each lamp 300, the exhaust pipe 6 is left for a predetermined length even after the xenon gas is sealed, because the exhaust pipe 6 is used in the pressure test performed later.

[Pressure Test]

An operation in which the lamp is turned on for 30 minutes and the lamp is turned off for 30 minutes is defined as one cycle, and this cycle was repeated 100 times for each of the six lamps 300 (Samples 1 to 3 and Samples 4 to 6) with a rated input of 4 kW.

After each lamp was repeatedly turned on, the exhaust pipe 6 was opened to remove the sealed xenon gas, and ethanol (liquid) was injected through the exhaust pipe 6. A pressure test (so-called alcohol pressure test) was performed by controlling the ethanol supply pressure by a compressor (not shown) and gradually increasing the internal pressure of the lamp 300. Then, the internal pressure when the lamp 300 ruptured was measured, and the location of the crack that was the starting point of the rupture was confirmed. The test results are shown in Table 1.

TABLE 1

| | Coating film | Pressure resisting strength | Rupture pressure [atm] | Starting point of rupture |
|---|---|---|---|---|
| Sample 1 | Formed | High | 77 | Arc tube section |
| Sample 2 | Formed | High | 72 | Arc tube section |
| Sample 3 | Formed | High | 75 | Arc tube section |
| Sample 4 | Not formed | Low | 58 | Side tube section near wire |
| Sample 5 | Not formed | Low | 62 | Side tube section near wire |
| Sample 6 | Not formed | Low | 57 | Side tube section near wire |

Table 1 shows that the lamps of Samples 4 to 6 ruptured starting from the side tube section near the wire when a pressure of 57 to 62 atm was applied to the lamps as a result of gradually increasing the pressure applied to the lamps. This is presumed to be because strain was accumulated in the portion where the wire and the inner wall of the side tube section were in close contact with each other because of expansion and contraction of each lamp due to the lamp being repeatedly turned on and off 100 times, and this led to the rupture starting from the crack in the portion where strain was accumulated.

On the other hand, the lamps of Samples 1 to 3 in Table 1 did not rupture even when a pressure of 57 to 62 atm was applied to the lamps. Table 1 shows that the lamps of Samples 1 to 3 then eventually ruptured starting from the arc tube section when a pressure of 72 to 77 atm was applied to the lamps as a result of gradually increasing the pressure applied to the lamps. This is presumed to be because the interposition of the silica coating film prevented the wire from being in close contact with the inner wall of the side tube section, which suppressed the occurrence of strain in the portion where the wire and the inner wall of the side tube section were in contact with each other. Therefore, it is considered that rupture of the side tube section near the wire at a low pressure was prevented, and each lamp could withstand the increasing pressure until rupture occurred at the arc tube section at a high pressure.

The present invention is not limited to the embodiment and examples described above, and various reformations and modifications can be made without departing from the spirit of the present invention.

What is claimed is:

1. A short-arc discharge lamp comprising:

an arc tube section;

at least one side tube section connected to at least one end of the arc tube section;

at least one electrode provided inside the arc tube section; and at least one lead rod which is provided inside the at least one side tube section and which is connected to the at least one electrode;

wherein the at least one lead rod has at least one metal body disposed so as to be in contact with the at least one lead rod;

the at least one side tube section has at least one reduced diameter region;

the at least one reduced diameter region indicates a region having a smaller diameter than a diameter of a region of the at least one side tube section excluding the at least one reduced diameter region;

the at least one lead rod is supported by the at least one reduced diameter region via the at least one metal body in a first support section and is supported by the at least one side tube section via a sealing glass that alleviates a difference in thermal expansion between the at least one side tube section and the lead rod in a second support section;

the at least one lead rod, the at least one metal body, and the at least one reduced diameter area are aligned along a plane perpendicular to the central axis of the at least one side tube; and at least one coating film is formed on at least one surface of the at least one metal body.

2. The short-arc discharge lamp according to claim 1, wherein the at least one coating film contains silica.

3. The short-arc discharge lamp according to claim 1, wherein thickness of the at least one coating film is not less than 1 μm or but not greater than 100 μm.

4. The short-arc discharge lamp according to claim 1, wherein the at least one coating film contains silica; and, thickness of the at least one coating film is not less than 1 μm but not greater than 100 μm.

5. The short-arc discharge lamp according to claim 1, wherein the at least one metal body contains tungsten.

6. The short-arc discharge lamp according to claim 1, wherein the at least one metal body contains molybdenum.

7. The short-arc discharge lamp according to claim 1, wherein the at least one end of the arc tube section includes a first end and a second end;

wherein the at least one side tube section includes a first side tube section and a second side tube section;

wherein the at least one electrode includes an anode and a cathode;

wherein the at least one lead rod includes a first lead rod and a second lead rod;

wherein the at least one metal body includes a first metal body and a second metal body;

wherein the at least one coating film includes a first coating film and a second coating film;

wherein the at least one surface includes a first surface and a second surface;

wherein the first side tube section and the second side tube section are respectively connected to the first end and the second end of the arc tube section;

wherein the first lead rod and the second lead rod are respectively provided inside the first side tube section and the second side tube section, and are respectively connected to the anode and the cathode; and wherein the first coating film and the second coating film are respectively formed on the first surface and the second surface, the first surface and the second surface respectively being present at the first metal body and the second metal body, the first side tube supporting the first lead rod via the first metal body, and the second side tube supporting the second lead rod via the second metal body.

8. The short-arc discharge lamp according to claim 1, wherein the at least one metal body is at least one wire wound around the at least one lead rod.

9. The short-arc discharge lamp according to claim 1, wherein the at least one coating film contains silica; and the at least one metal body is at least one wire wound around the at least one lead rod.

10. The short-arc discharge lamp according to claim 1, wherein thickness of the at least one coating film is not less than 1 μm but greater than 100 μm; and the at least one metal body is at least one wire wound around the at least one lead rod.

11. The short-arc discharge lamp according to claim 1, wherein the at least one coating film contains silica;

thickness of the at least one coating film is not less than 1 μm but not greater than 100 μm; and the at least one metal body is at least one wire wound around the at least one lead rod.

* * * * *